US007473328B2

(12) United States Patent
Yamasaki et al.

(10) Patent No.: US 7,473,328 B2
(45) Date of Patent: Jan. 6, 2009

(54) COMPOSITE ALLOY HAVING A THREE-DIMENSIONAL PERIODIC HIERARCHICAL STRUCTURE AND METHOD OF PRODUCING THE SAME

(76) Inventors: Tohru Yamasaki, 1778-1-307, Matogata, Matogata-cho, Himeji-shi, Hyogo (JP); Takayasu Mochizuki, 6-40-3, Honmachi, Shibuya-ku, Tokyo (JP)

( * ) Notice: Subject to any disclaimer, the term of this patent is extended or adjusted under 35 U.S.C. 154(b) by 543 days.

(21) Appl. No.: 10/924,970

(22) Filed: Aug. 25, 2004

(65) Prior Publication Data

US 2005/0045252 A1 Mar. 3, 2005

(30) Foreign Application Priority Data

Aug. 26, 2003 (JP) ..... 2003-343794

(51) Int. Cl.

| | |
|---|---|
| ***C22C 19/03*** | (2006.01) |
| ***C22C 1/00*** | (2006.01) |
| ***C22C 7/00*** | (2006.01) |
| ***C21D 1/54*** | (2006.01) |
| ***C25D 21/12*** | (2006.01) |
| ***C25D 7/08*** | (2006.01) |
| ***C25D 5/10*** | (2006.01) |

(52) U.S. Cl. ..... 148/426; 205/82; 205/116; 205/118; 205/170; 148/508; 148/400

(58) Field of Classification Search ..... 148/426; 205/118, 82, 170, 116

See application file for complete search history.

(56) References Cited

U.S. PATENT DOCUMENTS

| | | | | |
|---|---|---|---|---|
| 5,641,391 | A * | 6/1997 | Hunter et al. | 205/80 |
| 6,261,469 | B1 * | 7/2001 | Zakhidov et al. | 216/56 |
| 6,409,907 | B1 * | 6/2002 | Braun et al. | 205/317 |
| 6,993,235 | B2 * | 1/2006 | Takagi et al. | 385/129 |
| 6,998,942 | B2 * | 2/2006 | Kirihara et al. | 333/239 |
| 2002/0197042 | A1 * | 12/2002 | Kittaka et al. | 385/131 |

FOREIGN PATENT DOCUMENTS

JP 2001-342591 A 12/2001

OTHER PUBLICATIONS

A. Inoue et al., "Formation and properties of Zr-based bulk quasicrystalline alloys with high strength and good ductility," J. Mater. Res., vol. 15, No. 10, Oct. 2000, pp. 2195-2208, © 2000 Materials Research Society.

(Continued)

*Primary Examiner*—Roy King
*Assistant Examiner*—Christopher Kessler
(74) *Attorney, Agent, or Firm*—Foley & Lardner LLP

(57) ABSTRACT

A composite alloy has a three-dimensional periodic hierarchical structure having hard and soft metallic phases periodically arranged with a period having a length ranging from a nanometer scale to a millimeter scale. It is preferable that the three-dimensional periodic hierarchical structure has an alloy composition sloped microscopically within the period. The three-dimensional periodic hierarchical structure may be formed by periodically arranging rod-like hard and soft metallic phases having a width and a thickness ranging from a nanometer scale to a millimeter scale so that their side surfaces are adjacent to one another.

10 Claims, 5 Drawing Sheets

OTHER PUBLICATIONS

J.D. Madden et al., "Three-Dimensional Microfabridation by Localized Electrochemicial Deposition," J. of Microelectromechanical Systems, vol. 3. No. 1, Mar. 1996, pp. 24-32.

T. Yamasaki, "High-strength Nanocrystalline ni-W Alloys Produced by Electrodeposition and their Embrittlement Behaviors During Grain Growth," Scripta Materialia vol. 44, Nos. 8, 9 (2001), pp. 1497-1502.

* cited by examiner

COMPOSITE ALLOY HAVING A THREE-DIMENSIONAL PERIODIC HIERARCHICAL STRUCTURE AND METHOD OF PRODUCING THE SAME

This application claims priority to prior Japanese patent application JP 2003-343794, the disclosure of which is incorporated herein by reference.

BACKGROUND OF THE INVENTION

This invention relates to an alloy and a method of producing the same.

In order to provide hard amorphous alloys, bulk metallic glass and nanocrystalline alloys with high plastic deformability, it is effective to finely disperse a soft metallic phase, which is easy in plastic deformation, in the alloy. In most of the amorphous alloys and nanocrystalline alloys which manifests high strength and high toughness, perfect adherence bending (i.e., 180-degrees bending without breaking) is possible in a thin film state and 100% plastic extensional deformation is realized on a bending surface although these alloys are hard materials. However, when a tensile test is performed on these alloys, the plastic deformation is locally generated and brittle fracture is caused even by very slight elongation. Presumably, this is because these materials do not exhibit work hardening and plastic deformation locally progresses.

Therefore, in order to provide hard amorphous alloys, bulk metal glass and nanocrystalline alloys with high plastic deformability, it is required to widely and finely disperse the soft metallic phase, which is easy in plastic deformation, as a plastically deformable region in the alloy, thereby stopping the local progress of the plastic deformation and dispersing the plastic deformation. Thus, high plastic elongation is expected upon tensile deformation.

Under the circumstances, it has been tried to form a nanoscale composite structure obtained by finely dispersing precipitated phases which have a good coherency with a parent phase (see A. Inoue et al., "Formation and properties of Zr-based bulk quasicrystalline alloys with high strength and good ductility", J. Mater. Res., Vol. 15, No. 10 (2000), pages 2195-2208).

Referring to FIG. 1, an alloy structure comprises a bulk metallic glass as a parent phase and a quasi-crystalline phase well coherent with the parent phase and finely dispersed in the metallic glass. For this alloy structure, some improvement in plastic deformability upon compressive deformation is reported. However, plastic workability of a dispersed precipitated phase with a quasi-crystalline structure is bad. As shown in the illustrated example, it is difficult by known methods using heat treatment and the like to intentionally disperse the soft precipitated phase having both coherency with the parent phase and high plastic deformability in hard amorphous alloys, bulk metallic glass and nanocrystalline alloys.

On the other hand, in the electrodeposition (i.e., electrolytic deposition) method, it is possible by controlling a potential or a current density to electrodeposit only depositable alloys or atomic elements. It is known so far that a Ni(nickel)—W(tungsten) nanocrystalline alloy produced by using the electrodeposition method exhibits high strength and high toughness. Specifically, the perfect adherence bending is possible and the tensile fracture strength exceeds 2000 MPa (T. Yamasaki, "High-strength nanocrystalline Ni—W alloys produced by electrodeposition and their embrittlement behaviors during grain growth", Scripta mater. 44 (2001), pages 1497-1502).

By locally depositing nickel on a substrate by electrodeposition using a needle-like single-anode electrode and precisely moving the position of the needle-like electrode in synchronization with an electrodeposition rate, columnar and helical three-dimensional structures made of nickel with a diameter of 10 microns and a height of 100 microns were produced (John D. Madden and Jan W. Hunter, "Three-Dimensional Microfabrication by Localized Electrochemical Deposition", Journal of Microelectromechanical Systems, Vol. 5, No. 1, March 1996, pages 24-32). However, this method is different from the technique of artificially controlling local structures and compositions in an electrodeposited material throughout the whole electrodeposited material and does not create a bulk alloy having high strength and high ductility.

It is extremely difficult to successfully form the above-mentioned dispersed phase only by adjusting a heat treatment condition that determines the composition of the amorphous alloy and its partial crystallization. In many cases, the embrittlement is caused by the heat treatment. Therefore, the structure of the alloy produced by the conventional technology is far different from an ideal composite structure of the nanoscale and achieves neither the expected strength nor the expected plastic deformability.

On the other hand, the nanocrystalline Ni—W alloy produced by the conventional electrodeposition method has high strength and high toughness, but its rupture elongation under tension is not greater than 0.5%. Thus, the Ni—W nanocrystalline alloy has the same defect as the amorphous alloy or the nanocrystalline alloy produced by the conventional rapid quenching technique from the liquid state, etc.

SUMMARY OF THE INVENTION

It is an object of this invention to provide a composite alloy which simultaneously has high strength and high plastic workability.

Other objects of this invention will become clear as the description proceeds.

According to an aspect of this invention, there is provided a composite alloy having a three-dimensional periodic hierarchical structure comprising hard and soft metallic phases periodically arranged with a period having a length ranging from a nanometer scale to a millimeter scale.

According to another aspect of this invention, there is provided a method of producing a composite alloy having a three-dimensional periodic hierarchical structure, wherein said composite alloy is produced by depositing hard and soft metallic phases using electrodeposition so that the structure and the material composition of the alloy are periodically changed in a three-dimensional space with a period having a length ranging from a nanometer scale to a millimeter scale.

This invention makes it possible to provide an alloy which has a three-dimensional periodic hierarchical structure with a period having a length ranging from a nanometer scale to a millimeter scale and which simultaneously realizes high strength and high plastic workability. The alloy is produced by using a needle multi-electrode anode assembly comprising a plurality of needle-like anode electrodes in a two-dimensional matrix-like or grid-like array, individually controlling the potential of each individual electrode to perform selective electrodeposition while locally controlling an alloy composition and an alloy organization and, in addition, controlling the waveform of a pulse voltage and the anode-to-cathode distance with time so that a hard amorphous metallic phase or nanocrystalline phase and a soft metallic phase are distributed in an optimum period in both of a plane direction and a thickness direction.

The composite alloy obtained in this invention has realized an ideal alloy structure, namely, a "composite structure of a nanometer scale" in which a soft precipitated phase having a good coherency with a parent phase and a lower yield strength upon tensile deformation as compared with the parent phase", in a three-dimensional periodic hierarchical structure.

DESCRIPTION OF THE PREFERRED EMBODIMENT

Figure 1:
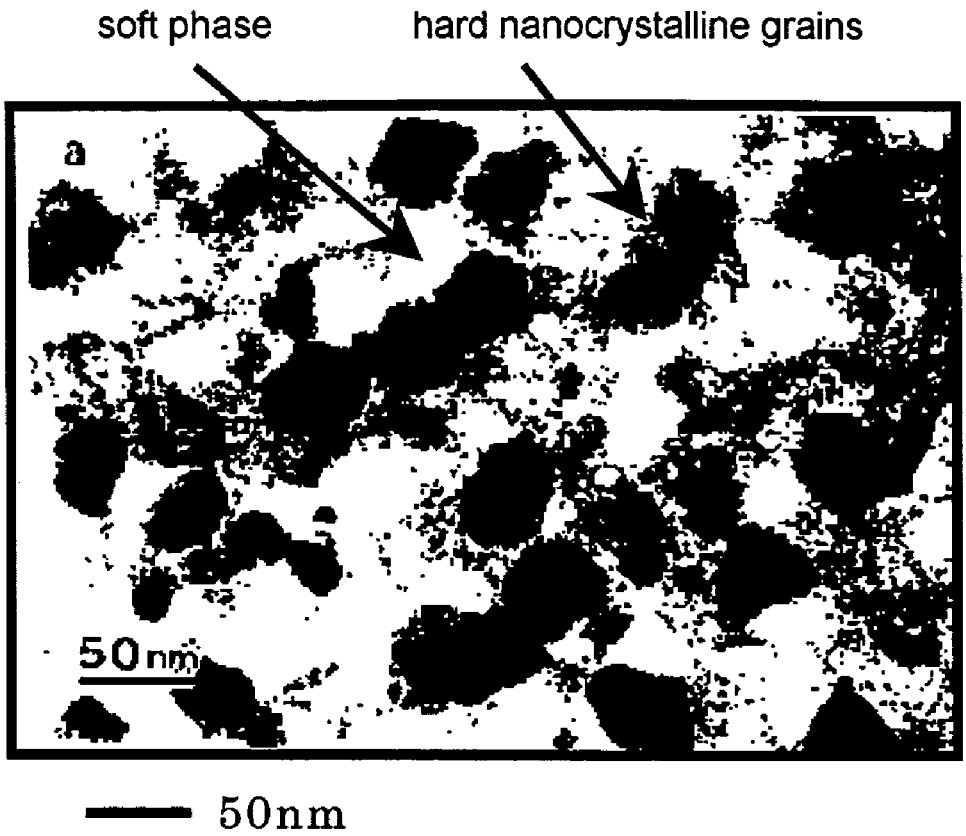
FIG. 1 PRIOR ART
FIG. 1 shows an example of an alloy organization which comprises a hard bulk metallic glass as a parent phase and precipitated phases which are well coherent with the parent phase, thereby being dispersed by heat treatment in the hard bulk metallic glass.

Now, an embodiment of this invention will be described with reference to the drawing.

Figure 2A:
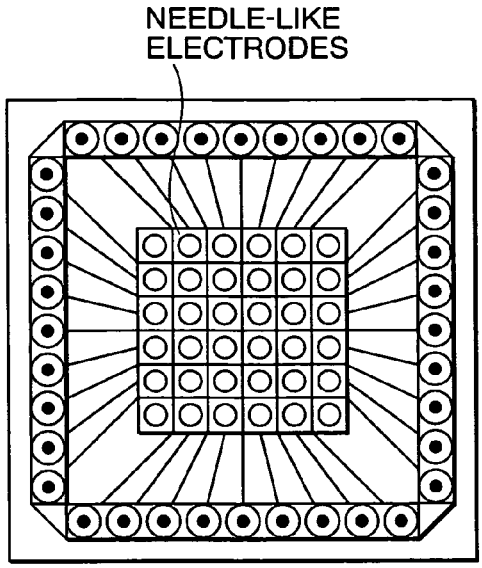
FIG. 2A is a plan view of a needle multi-electrode anode assembly according to an embodiment of this invention.
Figure 2B:
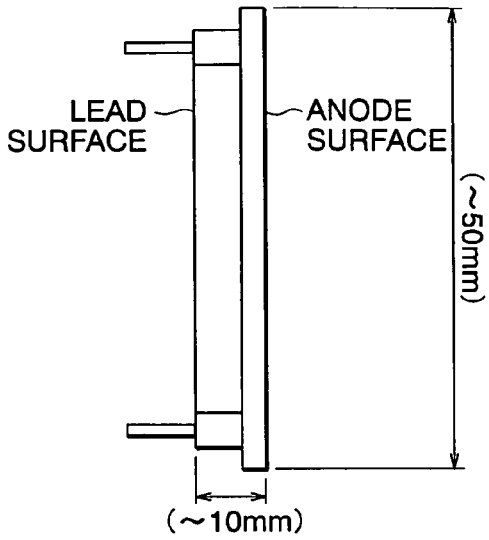
FIG. 2B is a sectional view of the needle multi-electrode anode assembly of FIG. 2A.

Referring to FIGS. 2A and 2B, a needle-like multi-electrode anode assembly according to one embodiment of this invention will be described.

It has been confirmed that, in the electrodeposition for producing an Ni—W alloy, the content of W in the alloy can be intentionally and locally controlled by local potential control in an electrodeposition bath tank 1. In the electrodeposition, a needle-like multi-electrode anode assembly 2 comprises a group of a plurality of anode electrodes distributed two-dimensionally in a matrix-like or grid-like array, as shown in FIG. 2A. Each of the anode electrodes is connected to a potentio-galvanostat precision power supply 5 and independently controlled in potential.

Figure 3:
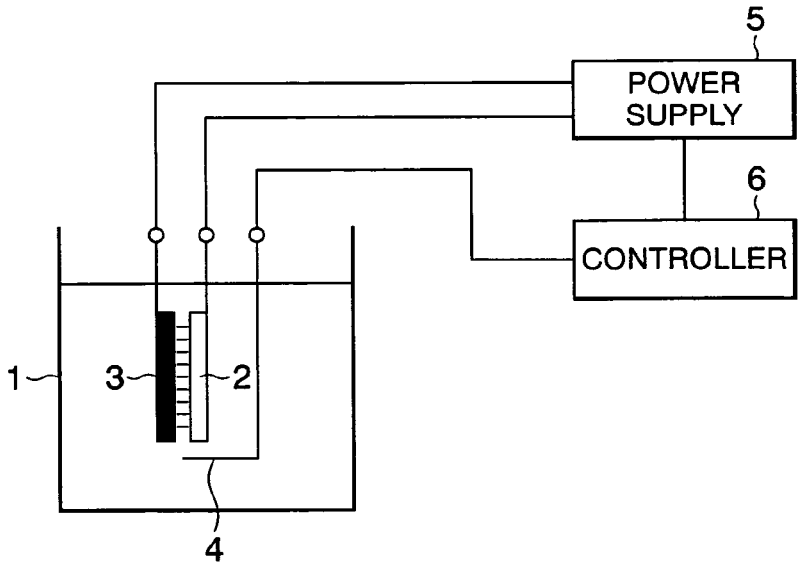
FIG. 3 is a view for describing a concept of an electrodeposition method using the multi-electrode anode assembly.

Referring to FIG. 3, description will be made of the concept of the electrodeposition using the multi-electrode anode assembly 2 in the electrodeposition bath tank 1. Each precision power supply 5 is provided with a function to feed a pulsed current. By controlling operations of the precision power supplies 5 by a controller 6 having a program preset beforehand, the current supplied to each electrode and flowing into a cathode 3 is independently controlled with time so as to provide electric potential distribution in both of a plane direction and a thickness direction during electrodeposition and to control the electric potential distribution with time, thereby achieving three-dimensional electrodeposition control.

By placing platinum monitoring electrodes 4 for measuring a standard potential at four corners of an electrodeposition plane, an average potential in an electrolytic solution is continuously monitored and a monitor signal representative of the average potential is fed back to the controller 6 to ensure the stability and the uniformity of the electrodeposition rate.

According to the method of producing a high-strength nanocrystalline electrodeposited Ni—W alloy disclosed in Japanese Patent Application Publication (JP-A) No. 2001-342591, it is possible to control the content of W in the electrodeposited alloy by controlling the potential applied during the electrodeposition, namely, by controlling the current density. Especially, a potential above a predetermined critical potential is necessary for the electrodeposition of W atoms to take place. Below the critical potential, the electrodeposition takes place only for Ni, but not for W. Therefore, it is possible to controllably selectively deposit a high-strength Ni—W alloy phase and a soft Ni phase by adjusting the potential around the critical potential.

In the electrodeposition, the potential is controlled by the controller 6 around the above-mentioned critical potential by using the aforesaid multi-electrode anode assembly so that desired alloy composition distribution will be obtained in both of the plane direction and the film thickness direction of an electrodeposited alloy sample. Especially, the potential is controlled so that the hard nanocrystalline Ni—W phase and the soft Ni phase are electrodeposited alternately in three-dimensional directions. During the electrodeposition, the feedback control is carried out simultaneously by using the monitor signal from the monitoring electrodes 4.

Figure 4A:
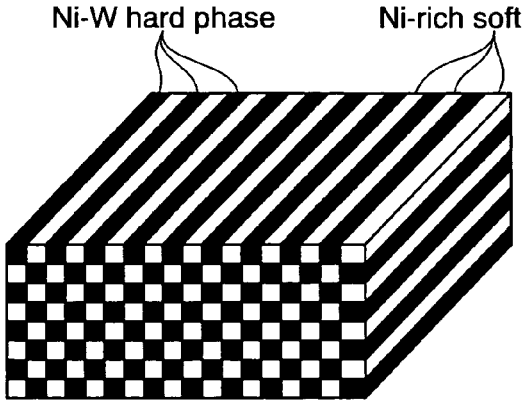
FIGS. 4A and 4B show examples of a composite alloy having a three-dimensional periodic hierarchical structure produced under artificial control.
Figure 4B:
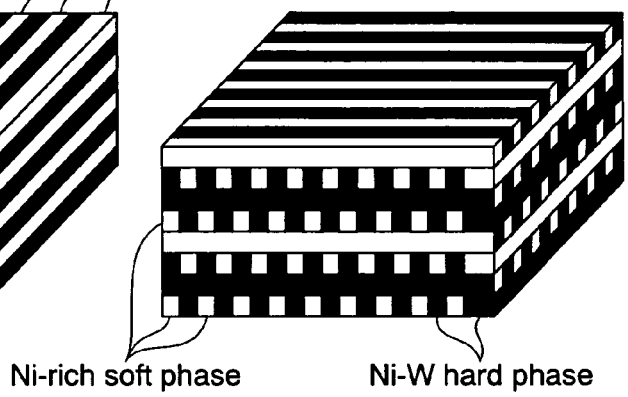

Referring to FIGS. 4A and 4B, description will be made of examples of an electrodeposited Ni—W composite alloy produced by artificial control as described above and having a three-dimensional hierarchical structure with a spatial period of a length ranging from a nanometer scale to a millimeter scale. FIGS. 4A and 4B schematically show cross sectional structures of the electrodeposited alloys in which a Ni—W phase and a Ni phase coexist periodically in a uni-directional type and in a bidirectional type, respectively.

Referring to FIG. 4A, each of the hard metallic phases (Ni—W) and the soft metallic phases (Ni) has a rod-like shape with a width and a thickness ranging from a nanometer scale to a millimeter scale. The hard metallic phases and the soft metallic phases are alternately arranged both in a plane direction and in a thickness direction with their side surfaces adjacent to one another to form a three-dimensional periodic hierarchical structure.

Referring to FIG. 4B, the rod-like hard and soft metallic phases having a width ranging from a nanometer scale to a millimeter scale are alternately arranged in the plane direction with their sides adjacent to one another to form an alloy board having a uniform thickness in the range from a nanometer scale to a millimeter scale. Then, the alloy board is overlapped with an adjoining alloy board so that a tilted angle is formed between the directions of the rod-like metal phases constituting the alloy board and the adjoining alloy board. By overlapping a plurality of alloy boards in the similar manner, the three-dimensional periodic hierarchical structure is formed.

Figure 5:
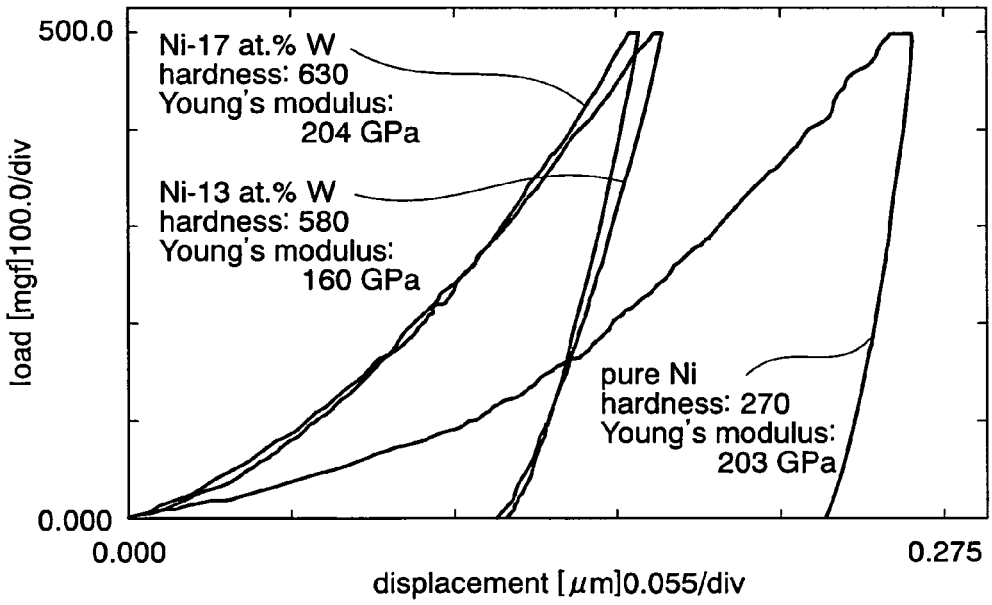
FIG. 5 is a view showing measured values of hardness and Young's modulus of nanocrystalline Ni—W phases and an Ni phase which have been electrodeposited by potential control.

Referring to FIG. 5, hardness and Young's modulus of the Ni—W phase and the Ni phase of a nanoscale produced by the aforesaid potential control were measured.

Under the same load condition, the indentation depth of a diamond indenter is deeper in the pure Ni phase than in the Ni—W phase. Thus, the region of the pure Ni phase is soft as compared with the Ni—W phase. On the other hand, in the region of the Ni—W alloy phase where W is added to Ni, a remarkable increase in hardness due to the miniaturization effect of crystal grains and the solid solution effect of W atoms is observed. Although the Young's modulus is generally lowered by the crystal grain miniaturization effect as observed in the Ni-13 at. % W alloy region, it is possible to achieve the Young's modulus substantially equal to that of the pure Ni phase by increasing the content of W up to 17 at. %.

As described above, in the method of producing the alloy according to this invention, it is possible to combine composite structures of various levels of hardness and Young's modulus by adjusting manufacturing conditions. Thus there is an advantage that, by forming a composite structure including the hard phase and the soft phase, it is possible to produce the optimum composite alloy which has both high strength and high ductility and which has precision spring deformation characteristics originating from the controlled Young's modulus, responding to the requirements in intended applications.

The alloy of this invention having a three-dimensional periodic hierarchical structure not only has the excellent mechanical performance described above but also has another advantage that electrical characteristics are improved, for example, electrical conductivity is drastically increased by coexistence of the Ni phase and the Ni—W alloy phase unlike the case of existence of the Ni—W alloy phase alone.

Figure 6:
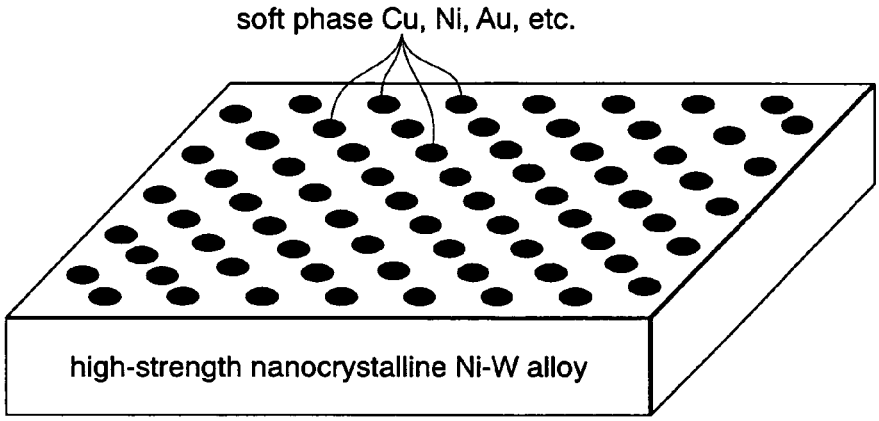
FIG. 6 shows an example of a composite alloy having a three-dimensional periodic hierarchical structure which has been produced by combining optical lithography with the electrodeposition method of this invention.

Referring to FIG. 6, description will be made of a composite alloy having a three-dimensional periodic hierarchical structure produced by combining optical lithography with the electrodeposition. In a high-strength nanocrystalline Ni—W alloy as a hard phase, rod-like soft metallic phases, such as Cu, Ni, Au, etc., having a cross-sectional size ranging from a nanometer scale to a millimeter scale are disposed with an interval ranging from a nanometer scale to a millimeter scale in such a way that the composite alloy has a three-dimensional periodic hierarchical structure. As will later be described in conjunction with FIGS. 8A to 8D, columns made of a resist material are formed by using the optical lithography so that the columns are distributed periodically along the plane direction with the interval from a nanometer to a millimeter scale. Thereafter, the high-strength nanocrystalline Ni—W alloy is electrodeposited in the thickness direction. After the resist material is removed, the soft metallic phases, such as Cu, Ni, and Au, etc., are electrodeposited in cavities formed after the resist material is removed. In the above-mentioned manner, it is possible to produce the composite alloy having a three-dimensional periodic hierarchical structure which has excellent mechanical and electrical performances as shown in FIG. 6.

When the composite alloy having a three-dimensional periodic hierarchical structure is produced by selectively electrodepositing the hard Ni—W phases and the soft Ni phases by the aforesaid potential control, it is possible to provide the alloy with a microscopically sloped composition and to adjust and control the hard nanocrystalline Ni—W phase and the soft Ni phase in such a way that these phases have designed volumetric percentages. Therefore, an ideal material structure for the improvement in mechanical characteristics is obtained since the alloy composition is microscopically sloped and three-dimensionally arranged.

When the conventional material structure technique is used, an interface between the soft and the hard phases forms a clear boundary surface. This often results in degradation of the material by interface peeling, etc. The alloy produced according to this invention can solve these material problems. Therefore, it is possible to produce a new material which is excellent in abrasion resistance, etc. while both of the high-strength and the high ductility are maintained.

Figure 7:
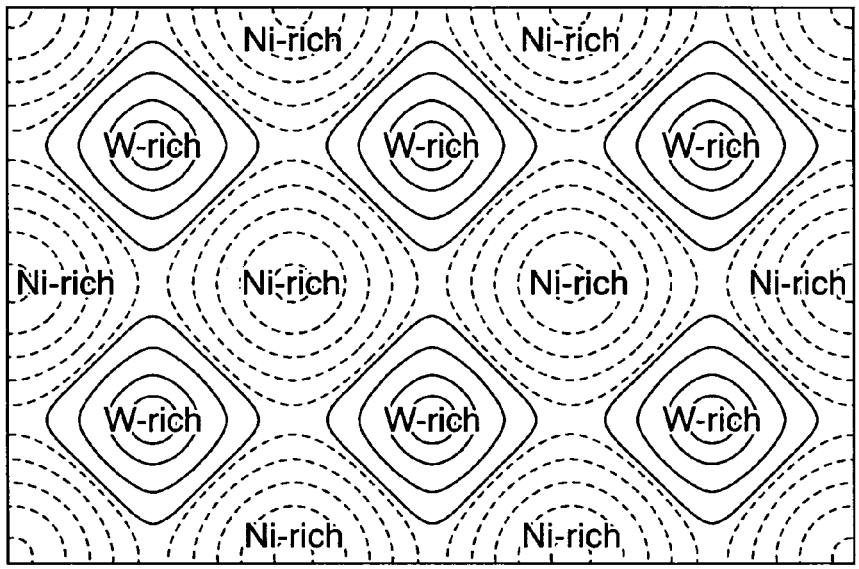
FIG. 7 is a schematic view showing the structure of an alloy having a three-dimensional periodic array whose composition is sloped microscopically, where each curve shows a contour line of a composition value.

Referring to FIG. 7, an alloy having a three-dimensional periodic array with a microscopically sloped composition is obtained by the method of this invention. By adjusting and controlling the hard nanocrystalline Ni—W phase and the soft Ni phase so that these phases have predetermined volumetric percentages, it is possible to create a network structure of the hard and the soft phases and to slope the content of W microscopically or macroscopically. Each curve shows a contour line of the composition value. For example, although the Ni—W alloy tends to generate residual stress during electrodeposition, it is possible to suppress the residual stress using the above-mentioned technique of controlling the three-dimensional alloy composition.

Referring to FIGS. 8A through 8D, description will be made of an example of a method of producing a microstructure body by using the composite material having the three-dimensional periodic hierarchical structure.

Figure 8A:
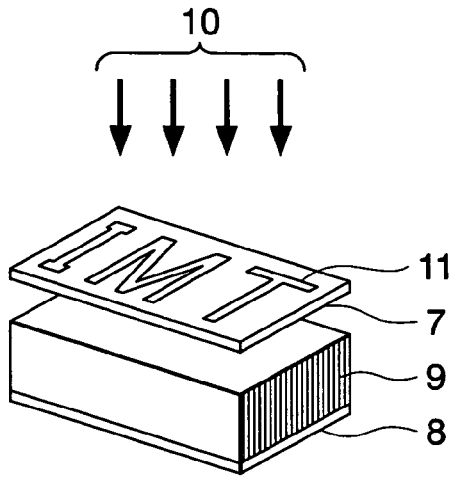
FIGS. 8A through 8D show an example of a production process of a microstructure body using the composite material having a three-dimensional periodic hierarchical structure according to this invention, 8A, 8B, 8C, and 8D showing exposure, development, electrodeposition, removal of a residual resist material, respectively.

Referring to FIG. 8A, an exposure step will be described. In the exposure step, photopolymer (photosensitive polymer) as a resist material 9 applied on a conductive substrate 8 is exposed through a photo-mask 7 by synchrotron radiation or ultraviolet ray 10.

Figure 8B:
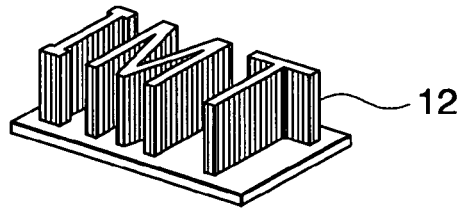

Referring to FIG. 8B, a photopolymer development step will be described. The photomask 7 has a pattern 11 shown as "IMT". The pattern 11 comprises an optical absorber which absorbs the synchrotron radiation or the ultraviolet ray 10. By the synchrotron radiation or the ultraviolet ray 10 passing through the photomask 7 in an area except the absorber pattern 11, molecular chains in the photopolymer resist material 9 exposed in the above-mentioned area are cut. Accordingly, a part of the resist material 9 in the above-mentioned area is selectively dissolved in a specific developer. By the above-mentioned development step, a microstructure body 12 comprising the photopolymer resist material 9 is formed on the conductive substrate 8.

Figure 8C:
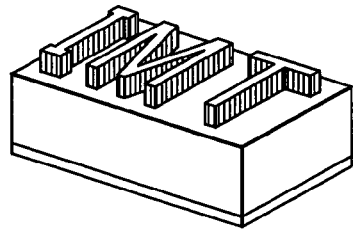

Referring to FIG. 8C, a metal deposition step by the electrodeposition method will be described. In the area where the photopolymer resist material 9 is dissolved, the high-strength and high-ductility composite alloy having the three-dimensional periodic hierarchical structure is electrodeposited according to the electrodeposition described above.

Figure 8D:
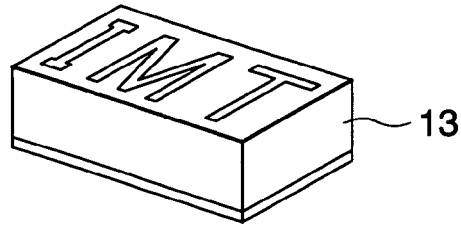

Referring to FIG. 8D, a residual resist removal step will be described. By removing residual photopolymer by a solvent, a microstructure body 13 of the high-strength, high-ductility composite alloy having a three-dimensional periodic hierarchical structure is obtained. According to this method, it is possible to mold a fine structure or a microstructure of a micrometer size that is difficult to mold by mechanical machining. In addition, a microstructure body of any desired shape can be formed by changing the shape of the optical absorber of the photo-mask.

Generally, as shown in FIGS. 8A through 8D, it is possible to carry out molding of the alloy simultaneously with production of the alloy by carrying out electrodeposition inside the three-dimensional cavity which has been produced by developing the minute pattern on a resist material by using the optical lithography.

By producing the composite material having the three-dimensional periodic hierarchical structure in a molding die, it is possible to mass-produce a minute alloy structure body having a high-function mechanical performance.

As described above, it is possible to artificially mass produce the composite structure which is characterized by a three-dimensional, optimum periodic hierarchical structure with a period having a length ranging from a nanometer scale to a millimeter scale. Therefore, it is possible to provide an inexpensive and high-function new material and parts made of the material, which have excellent electrical characteristics as well as high-hardness and high plasticity deformability.

While the present invention has thus far been described in connection with a few embodiments thereof, it will readily be possible for those skilled in the art to put this invention into practice in various other manners. For example, although the description has mainly been made about a case of the electrodeposited Ni—W alloy, it will readily be understood that the material to which this invention is applicable is not limited thereto.

What is claimed is:

1. A method of producing a composite alloy having a three-dimensional periodic hierarchical structure comprising a first metallic phase and a second metallic phase which is lower than the first metallic phase in hardness, the method comprising:

periodically arranging the first and the second metallic phases with a period having a length ranging from a nanometer scale to a millimeter scale; and adjusting and controlling volume ratios of the first and the second metallic phases to predetermined ratio by sloping a composition of the composite alloy within the period.

2. The method according to claim 1, wherein said composite alloy is produced by depositing the first and the second metallic phases using electrodeposition so that the structure and the material composition of the alloy are periodically changed in a three-dimensional space with a period having a length ranging from a nanometer scale to a millimeter scale, the electrodeposition comprising:

two-dimensionally arranging a plurality of depositing electrodes in a space within an electrodeposition bath tank;

arranging at least one monitoring electrode for measuring a standard potential in the electrodeposition bath tank in addition to said depositing electrodes;

independently controlling a potential of each of said depositing electrodes with time to thereby control spatial distribution of the potential in accordance with a predetermined control program; and feeding back a monitor signal from said monitoring electrode.

3. The method according to claim 1, wherein the adjusting and controlling step comprises microscopically sloping a composition of the composite alloy within the period to make the composite alloy have a three-dimensional periodic hierarchical structure in the composition.

4. The method according to claim 2, further comprising combining a two-dimensional pattern forming process to produce said composite alloy, wherein the two-dimensional pattern forming process uses optical lithography with the electrodeposition.

5. The method according to claim 2, wherein the electrodeposition is carried out in a three-dimensional cavity so that the composite alloy comprises a three-dimensional body simultaneously molded.

6. The method according to claim 1, wherein each of the first and the second metallic phases is rod-like and has a width and a thickness ranging from a nanometer scale to a millimeter scale, and the three-dimensional periodic hierarchical structure is formed by periodically arranging the first and the second metallic phases so that their side surfaces are adjacent to one another.

7. The method according to claim 1, wherein each of the first and the second metallic phases is rod-like and has a width ranging from a nanometer scale to a millimeter scale, the three-dimensional periodic hierarchical structure comprises a plurality of alloy boards each of which has a uniform thickness and comprises the first and the second metallic phases periodically arranged so that their side surfaces are adjacent to one another, and said alloy boards are overlapped with one another in such a manner that each of the first and the second metallic phases constituting one of adjacent ones of the alloy boards extends in a first direction and that each of the first and the second metallic phases constituting another of adjacent ones of the alloy boards extends in a second direction intersecting the first direction.

8. The method according to claim 1, wherein the second metallic phases have a rod-like shape whose cross-sectional size ranges from a nanometer scale to a millimeter scale, the second metallic phases being placed in the first metallic phase with an interval ranging from a nanometer scale to a millimeter scale so that the composite alloy has a three-dimensional periodic hierarchical structure.

9. The method according to claim 8, wherein said composite alloy is produced by combining a two-dimensional pattern forming process using optical lithography with electrodeposition.

10. The method according to claim 1, wherein the first metallic phase has a hardness of HV580-HV630.

* * * * *